United States Patent [19]

Weber et al.

[11] 4,392,637

[45] Jul. 12, 1983

[54] METALLURGICAL MELTING APPARATUS WITH A BLOW-NOZZLE OR BURNER CAPABLE OF SWIVELLING IN DIFFERENT DIRECTIONS

[75] Inventors: Ralph Weber, Sao Paulo, Brazil; Bernt Rollinger; Michael Nagl, both of Baden-Baden, Fed. Rep. of Germany; Bernhard Rinner, Kehl am Rhein, Fed. Rep. of Germany

[73] Assignees: Korf-Stahl AG, Fed. Rep. of Germany; Voest-Alpine AG, Austria

[21] Appl. No.: 300,903

[22] Filed: Sep. 10, 1981

[30] Foreign Application Priority Data

Sep. 12, 1980 [DE] Fed. Rep. of Germany ..... 3034520

[51] Int. Cl.[3] ..... C21B 7/16

[52] U.S. Cl. ..... 266/265

[58] Field of Search ..... 266/265

[56] References Cited

U.S. PATENT DOCUMENTS 966,704 8/1910 Pickles ..... 266/267

*Primary Examiner*—P. D. Rosenberg

[57] ABSTRACT

Metallurgical melting apparatus with a blow-nozzle or burner capable of swivelling in different directions. The blow-nozzle or burner comprises at least one tube. The nozzle-head (12) has a bulge, in the example described a spherical calotte (13), which is retained between two ring-seats (14 and 15) (the FIGURE).

12 Claims, 1 Drawing Figure

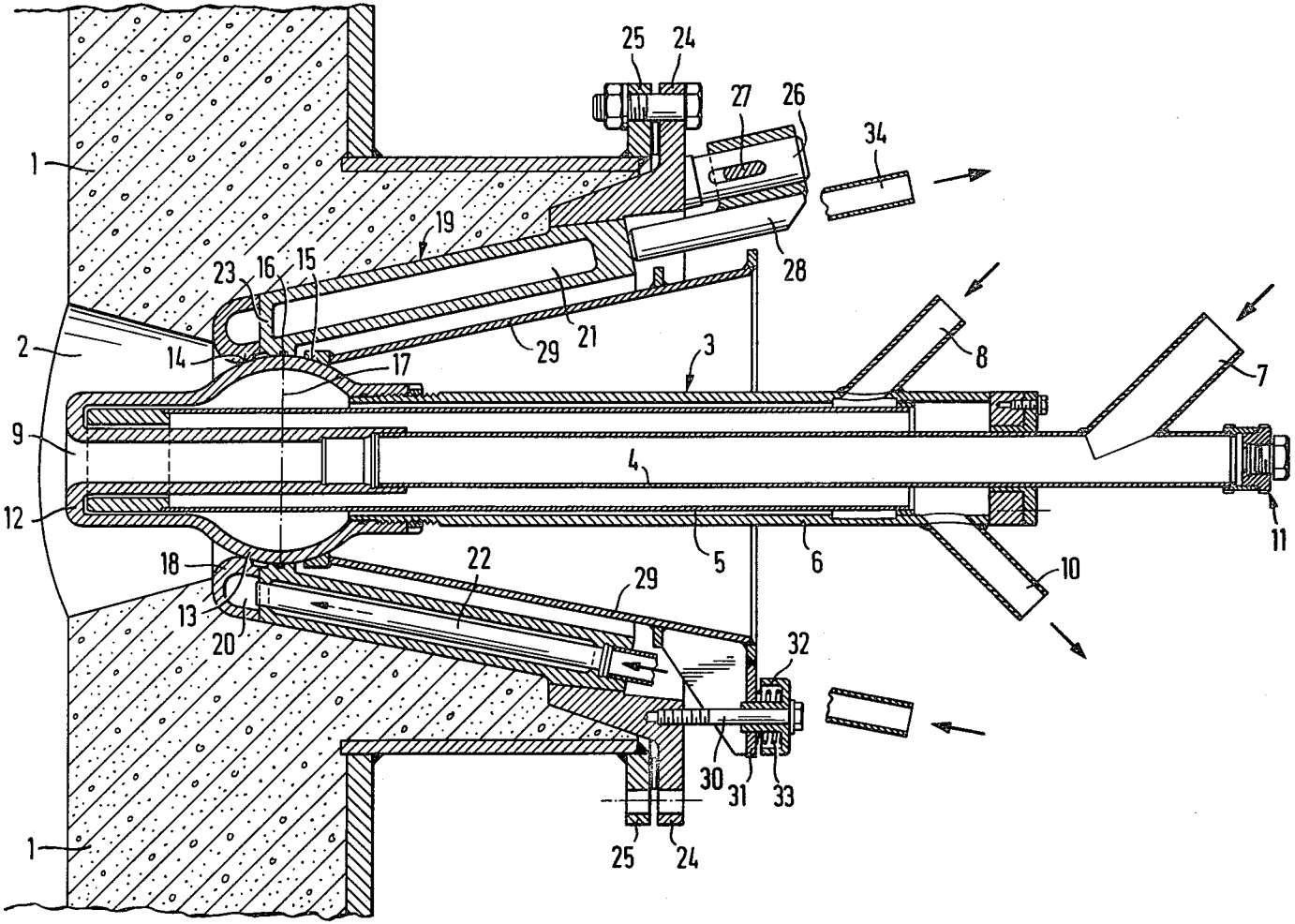
11
7
10
8
34
26
28
27
24
25
6
32
33
31
30
3
5
4
29
21
19
17
15
16
23
14
22
20
13
18
1
2
9
12

METALLURGICAL MELTING APPARATUS WITH A BLOW-NOZZLE OR BURNER CAPABLE OF SWIVELLING IN DIFFERENT DIRECTIONS

DESCRIPTION

The invention relates to a metallurgical melting apparatus such as a smelter-gasifier in which sponge iron is melted to form liquid pig iron and reduction gas is produced from feed coal and oxygen-bearing gas and also relates to a blow-nozzle or burner which is capable of being swivelled in different directions and comprises at least one tube for installation in the side-wall of a metallurgical melting apparatus above the level of the melt.

In the operation of a metallurgical melting apparatus of this kind it is often desired to swivel the burner or blow-nozzle within limits in one direction or another. From the German Gebrauchsmuster No. 1 863 633 an electric arc furnace is known for melting scrap, with a charging opening at the side equipped with a closure flap. Penetrating through the flap there is a burner which is supported on a stand in front of the furnace, with the help of two hinges so that the burner can be swivelled in different directions, i.e. both vertically and horizontally. To allow this movement of the burner the opening in the closure flap must be wider than the external diameter of the burner, i.e. there must be a clearance here and consequently there is no gas-tight seal, with the result that heat is lost from the melting furnace and the furnace atmosphere is upset. Although this might be tolerable in some kinds of melting apparatus, it is not in the case of a smelter-gasifier of the kind described, for example, in the German Offenlegungsschrift No. 28 43 303, in which not only melting takes place but also, and simultaneously, the production of a hot reduction gas.

The intention in the present invention is to provide a metallurgical melting apparatus of the kind described at the beginning, but which has a blow-nozzle or burner mounted in its side-wall in such a way that the blow-nozzle or burner can be swivelled in different directions, within angular limits, a substantially gas-tight seal being nevertheless maintained at all times between the blow-nozzle or burner and the side-wall of the apparatus. The arrangement must be safe to use and reliable in operation, in spite of the high temperatures involved, and it must be possible to remove and replace the blow-nozzle or burner in a simple manner.

The invention will now be described in greater detail with the help of the example represented in the drawing, which is a section through a detail of the side-wall of a smelter-gasifier.

The side-wall of a metallurgical smelter-gasifier, particularly of the kind described in the German Offenlegungsschrift No. 28 43 303, has an opening 2 above the level of the melt. Mounted in the opening 2 there is a blow-nozzle 3, for example for blowing oxygen into the interior of the smelter-gasifier for burning coal in order to produce, on the one hand, the heat necessary for melting the material contained in the smelter-gasifier and, on the other hand, for producing the reduction gas used in the metallurgical process. The blow-nozzle 3 has three coaxial tubes 4, 5, 6, the inner tube 4 forming, with the middle tube 5 and the outer tube 6, a central channel and two annular channels. The inner tube 4 is joined to the outer tube 6 by a nozzle-head 12. The process gas, in this case an oxygen-bearing gas, is fed to the inner tube 4 through an inlet connection 7. Cooling water is fed to the outer tube 6 through an inlet connection 8 and flows forwards as far as the nose 9 of the blow-nozzle 3. From there the water, passing through a transfer passage, flows backwards through the annular channel between the middle tube 5 and the inner tube 4 and finally leaves through an outlet connection 10. The inner tube 4 has, at its rear end, a screw-threaded adapter 11 for rapid connection to a feed-pipe conveying, for example, oil when it is desired to use the blow-nozzle as a burner.

To facilitate manufacture, and for easy dismantling, the blow-nozzle is assembled from several parts, as can be derived from the drawing.

The blow-nozzle is constructed to swivel in different directions and it is important to ensure that a good gas-tight seal is constantly maintained, particularly in view of the high temperature (about 2000° C.) and the considerable pressure (about 2 bars) existing in the interior of the smelter-gasifier. For this purpose the blow-nozzle 3 has an expanded portion, i.e. a bulge where it passes through the opening in the sidewall of the smelter-gasifier, and in the present example the bulge has the form of a spherical-surfaced calotte 13. To make the gas-tight seal, the calotte 13 is retained in place resiliently between a forward ring-seat 14 and a rear ringseat 15, which are coaxial to each other. The forward ring-seat 14, nearer the nozzle-head 9, is anchored in the sidewall 1 of the melting apparatus and bears on the forward portion of the spherical surface of the calotte 13. The rear ring-seat 15 is spring-mounted and bears resiliently on the rearward portion of the spherical surface of the calotte 13. Thus the calotte 13 is retained between the two ring-seats, which are pushed resiliently towards each other, and the forward ring-seat 14 makes a good seal with the spherical outer surface of the calotte 13, even during swivelling of the blow-nozzle, reliably preventing the atmosphere in the smelting apparatus from escaping outwards to the external atmosphere. If necessary, the quality of the seal can be improved by providing an annular gas-tight seal 16, situated between the two ring-seats 14 and 15 and bearing on the spherical outer surface of the calotte 13 at the transverse crest-plane 17 of the bulge. This seal 16 is not subjected to such high mechanical and thermal loads as the ring-seat 14 and can therefore provide a good sealing effect over a long working life.

The forward ring-seat 14 is constructed in the form of a liquid-cooled hollow ring 18 which, in this example, is a portion of a double-walled outer cone 19 between whose two walls there is an annular channel 21 for the circulation of a cooling liquid. The cooling liquid is introduced through a tube 22 inserted into the lower portion of the annular channel 21 so that the cooling liquid flows from here into the annular channel 20 of the forward ring-seat 14. This channel has a separating wall (not shown) so that the cooling liquid flows around in the channel 20 until, when it reaches the upper portion of this channel, it flows out through an opening back into the annular channel 21, which it leaves through an outlet tube 34 situated in the upper portion of the outer hollow cone 19.

Both the nozzle-head 12 and the outer hollow cone 19 are made of copper, to take advantage of the high thermal conductivity of this metal. The outer hollow cone 19, which supports the forward ring-seat 14, is installed by pushing it into the conical mouth of a steel annular flange 24 which is bolted at several places to an attachment flange 25 of the melting apparatus. The outer hollow cone 19 is pushed firmly into place with the help of three studs 26 projecting backwards from the annular flange 24. Each stud 26 has a slot to take a wedge 27, which acts on a thrust-pin 28 whose nose pushes against the back-surface of the outer hollow cone 19, thrusting the cone into place.

The rear ring-seat 15 is constructed as a portion of an inner hollow cone 29 which has a flange, at the rear, stiffened by brackets 37. Tightening screws 30, passing through the flange, screw into the annular flange 24 which retains the outer hollow cone 19. The head of each screw 30 retains a thrust cap 32 which itself contains a compression spring 33. It will be observed that tightening the screws 30 thrusts the rear ring-seat 15 towards the forward ring-seat 14, squeezing the spherical calotte between them. If it is desired to lock the blow-nozzle in position, i.e. so that it cannot be swivelled about, that can easily be done simply by drawing the screws 30 tight, to bring the thrust caps 32 into firm contact with the flange of the inner hollow cone 29. In this case the compression springs 33 are inoperative. On the other hand, to set the blow-nozzle free to swivel, the screws are unscrewed slightly, enough to bring the compression springs 33 into action. Under these circumstances the rear ring-seat 15 is pushed only resiliently forwards and the blow-nozzle is free to swivel. After the blow-nozzle has been adjusted in position it can, if desired, be locked in position as described above.

In this example the bulge is in the form of a spherical calotte 13. But the bulge need not necessarily have a spherical outer surface. What matters is that the forward ring-seat 14, if necessary with the help of the annular gas-tight seal 16, must ensure that a seal is obtained good enough for the particular requirements.

We claim:

1. A metallurgical melting apparatus, in which sponge iron is melted to form liquid pig iron and reduction gas is produced from feed coal and oxygen-bearing gas, comprising a blow-nozzle mounted in the side-wall of said apparatus above the level of the melt capable of swivelling in different directions and having at least one tube, a nozzle-head (12) attached to said tube (6), having a spherical surfaced calotte (13) a forward ring-seat (14) anchored to the side-wall (1) of the melting apparatus sealingly contacting a forward surface of the calotte (13), and a rear ring-seat (15) contacting a rear surface of the calotte (13) which thrusts the callotte forward towards the forward ring-seat (14).

2. Blow-nozzle capable of swivelling in different directions and comprising at least one tube for installation in the side-wall of a metallurgical melting apparatus above the level of the melt, and a nozzle-head (12) attached to the tube having a spherical surfaced calotte (13) which is retained resiliently between two ring-seats (14,15) respectively contacting forward and rear surfaces of said calotte and formed as portions of two member (19,29) of a supporting structure, the ring-seat (14) contacting the forward surface of said calotte sealingly contacting same.

3. A metallurgical melting apparatus as claimed in claim 1 characterised in that the two ring-seats (14, 15) are coaxial to each other.

4. A metallurgical melting apparatus as claimed in one of the claims 1 or 3, characterised in that an annular gas-tight seal (16) is interposed so as to bear on the surface of the calotte (13) between the two ring-seats (14, 15) in the transverse crest-plane of the calotte.

5. A metallurgical melting apparatus as claimed in one of the claims 1 or 2, characterised in that the forward ring-seat (14) is a portion of a liquid-cooled hollow ring (18).

6. A metallurgical melting apparatus as claimed in claim 5, characterised in that the forward ring-seat (14) is formed as the inner surface of the smaller end of an outer hollow cone (19).

7. A metallurgical melting apparatus as claimed in claim 6, characterised in that the outer hollow cone (19) has an annular channel (21) through which a cooling liquid circulates.

8. A metallurgical melting apparatus as claimed in claim 7, characterised in that an annular channel (21) of the outer hollow cone (19) communicates through at least one opening with the annular channel (20) formed by the hollow ring (18).

9. A metallurgical melting apparatus as claimed in claim 6, characterised in that the rear ring-seat (15) is formed as the inner surface of the smaller end of an inner hollow cone (29).

10. A metallurgical melting apparatus as claimed in claim 9, characterised in that the inner hollow cone (29) is thrust forwards towards the outer hollow cone (19) by springs (33).

11. A metallurgical melting apparatus as claimed in claim 6, characterised in that the outer hollow cone (19) is of copper and is installed removably by pushing it into the conical mouth of an annular steel flange (24).

12. A metallurgical melting apparatus as claimed in one of the claims 1 or 2, characterised in that the blow-nozzle (3) is liquid-cooled.

* * * * *